United States Patent [19]

Honjo et al.

[11] Patent Number: 4,938,467

[45] Date of Patent: Jul. 3, 1990

[54] APPARATUS FOR POST-PROCESSING OF SHEETS

[75] Inventors: Takeshi Honjo, Kawasaki; Koichi Murakami, Yokohama, both of Japan

[73] Assignee: Canon Kabushiki Kaisha, Tokyo, Japan

[21] Appl. No.: 175,347

[22] Filed: Mar. 30, 1988

[30] Foreign Application Priority Data

| | | | |
|---|---|---|---|
| Mar. 31, 1987 | [JP] | Japan | 62-078017 |
| Mar. 31, 1987 | [JP] | Japan | 62-078018 |
| Mar. 31, 1987 | [JP] | Japan | 62-078023 |
| Apr. 1, 1987 | [JP] | Japan | 62-080486 |

[51] Int. Cl.[5] ..... B65H 45/04; B65H 43/04

[52] U.S. Cl. ..... 271/202; 271/215; 271/217; 493/23; 493/29; 493/357

[58] Field of Search ..... 271/176, 199, 202, 207, 271/213, 214, 215, 217, 203, 288; 270/37, 39, 45; 493/2, 23, 29, 357, 358, 416

[56] References Cited

U.S. PATENT DOCUMENTS

| | | | |
|---|---|---|---|
| 3,749,395 | 7/1973 | Bazzarone et al. | 271/215 X |
| 3,814,415 | 6/1974 | Hunter et al. | 271/176 X |
| 4,033,579 | 7/1977 | Stange et al. | 271/217 X |
| 4,065,123 | 12/1977 | Arrasmith et al. | 271/215 |
| 4,254,342 | 3/1981 | McMillan | 271/215 X |
| 4,632,378 | 12/1986 | Sardella | 271/202 |
| 4,696,463 | 9/1987 | Nakazato et al. | 271/176 |

FOREIGN PATENT DOCUMENTS

| | | | |
|---|---|---|---|
| 0012248 | 2/1981 | Japan | 271/199 |
| 0072556 | 5/1982 | Japan | 271/199 |
| 0077158 | 5/1982 | Japan | 271/176 |
| 0157668 | 9/1983 | Japan | 271/199 |
| 0106763 | 6/1985 | Japan | 271/215 |
| 0169446 | 7/1986 | Japan | 271/213 |
| 0295970 | 12/1986 | Japan | 271/213 |
| 0088730 | 4/1987 | Japan | 271/217 |
| 0244864 | 10/1987 | Japan | 271/176 |

*Primary Examiner*—Joseph J. Rolla
*Assistant Examiner*—Glenn L. Heinl
*Attorney, Agent, or Firm*—Fitzpatrick, Cella, Harper & Scinto

[57] ABSTRACT

There is disclosed a sheet stacker, for use in combination with a copying machine, a printer or the like, capable of ensuring satisfactory sheet stacking regardless whether the sheet is folded or not. The apparatus controls the stacking operation in different modes in accordance with whether the sheets to be stacked are folded or not.

14 Claims, 20 Drawing Sheets

| | | | AT INITIALIZATION | | AT LOADING | | | AT END | | OVER LOAD ALARM | ALARM RELEASE |
|---|---|---|---|---|---|---|---|---|---|---|---|
| | | | TRAY POSITION | OPERATION TIMING | DOWN WAY & AMOUNT | CARRYING SPEED | CL TIMING OFF | NON-SORT | SORTING | | |
| NO FOLDING | TRAY STAND | SHEET SENSOR PRESENT | 15mm DOWN FROM HOME | SHEET DELIVERY *1 | 1.5mm DOWN/3SHEETS | 500mm/s | 40mm FROM SENSOR | 18mm DOWN | 18mm ↓ → 30mm | OUTPUT WHEN BOTH THE SENSOR 537 & 527 TURN ON | RELEASE WHEN SENSOR 527 TURNS ON |
| | | SHEET SENSOR ABSENT | ↑ | INHIBITION OF SHEET DELIVERY UNTIL COMPLETION OF INITIALIZATION *2 | NOT DOWN | ↑ | ↑ | ↑ | ↑ | ↑ | ↑ |
| | TRAY DOWN | SHEET SENSOR PRESENT | 9mm DOWN FROM HOME | *1 | 1.5mm DOWN/8SHEETS | ↑ | ↑ | 10mm DOWN | 10mm ↓ → 30mm | ↑ | ↑ |
| | | SHEET SENSOR ABSENT | ↑ | *2 | NOT DOWN | ↑ | ↑ | ↑ | ↑ | ↑ | ↑ |

FIG. 5A

| | | AT INITIALIZATION | | AT LOADING | | | AT END | | OVER LOAD ALARM | ALARM RELEASE |
|---|---|---|---|---|---|---|---|---|---|---|
| | | TRAY POSITION | OPERATION TIMING | DOWN WAY & AMOUNT | CARRYING SPEED | CL TIMING OFF | NON-SORT | SORTING | | |
| HALF FOLDING | TRAY STAND | SHEET SENSOR PRESENT | → | *1 | NOT DOWN | ← | NOT OFF | NOT DOWN | OUTPUT ON 100 SHEETS LOADING | RELEASE WHEN SHEET SENSOR TURNS OFF |
| | | SHEET SENSOR ABSENT | 36mm DOWN FROM HOME | *2 | ← | ← | ← | ← 30mm | ← | ← |
| | TRAY DOWN | SHEET SENSOR PRESENT | → | *1 | ← | ← | 40mm FROM SENSOR | ← | ← | ← |
| | | SHEET SENSOR ABSENT | 36mm DOWN FROM HOME | *2 | ← | ← | ← | ← | ← | ← |

FIG. 5B

| | | | AT INITIALIZATION | | AT LOADING | | | AT END | | OVER LOAD ALARM | ALARM RELEASE |
|---|---|---|---|---|---|---|---|---|---|---|---|
| | | | TRAY POSITION | OPERATION TIMING | DOWN WAY & AMOUNT | CARRYING SPEED | CL TIMING OFF | NON-SORT | SORTING | | |
| Z FOLDING | TRAY STAND | SHEET SENSOR PRESENT | ↓ | *1 | 15 OR LESS SHEETS: 1mm DOWN/SHEET 16 OR MORE SHEETS: 1mm DOWN/SHEET AT A4, AND 0.4mm DOWN/SHEET AT OTHER | ↑ | 58mm FROM SENSOR AT A4, AND 48mm FROM SENSOR AT OTHER | ↑ | ↑ | OUTPUT ON 30 SHEETS LOADING | ↑ |
| | | SHEET SENSOR ABSENT | 29mm DOWN FROM HOME | *2 | ↑ | ↑ | ↑ | ↑ | ↑ | ↑ | ↑ |
| | TRAY DOWN | SHEET SENSOR PRESENT | ↓ | *1 | 50 OR LESS SHEETS: NOT DOWN 51 OR MORE SHEETS: 1mm DOWN/SHEET | ↑ | 35mm FROM SENSOR | ↑ | ↑ | OUTPUT ON 100 SHEETS LOADING | ↑ |
| | | SHEET SENSOR ABSENT | 36mm DOWN FROM HOME | *2 | ↑ | ↑ | ↑ | ↑ | ↑ | ↑ | ↑ |

FIG. 5C

APPARATUS FOR POST-PROCESSING OF SHEETS

BACKGROUND OF THE INVENTION

1. Field of the Invention

The present invention relates to an apparatus for effecting a post-process for discharged sheets.

2. Related Background Art

There is already known an apparatus for storing the sheets discharged from a recording apparatus such as a copying machine or a printer on trays, by lowering trays stepwise when a predetermined number of discharged sheets are stacked on a tray, and interrupting the recording operation when the number of stacked sheets reaches an upper limit.

However, a sheet folding unit is often connected to such recording apparatus as mentioned above, and it is difficult, in such case, to ensure satisfactory sheet stacking, since the height of sheets stacked on a tray becomes different depending on whether said sheets are folded in said folding unit or not folded and the detection of the upper limit of the stacked sheet is difficult.

Also at the start of a copying job in such apparatus, satisfactory sheet stacking cannot be expected if the sheets obtained in a preceding copying job are removed from the tray, since the tray has been considerably lowered. In order to eliminate such difficulty, the apparatus can be so constructed to enable the copying job after a pause corresponding to the maximum time required for the tray to return to a reference position for sheet stacking, but such structure may deteriorate the throughput of the apparatus since, if the sheets obtained in the preceding copying job remain on the tray, said returning time is shorter as the upper level of the stacked sheets is close to said reference position.

Also folded sheets or large-sized sheets are often not stacked satisfactorily due to the rigidity of sheets, if they are discharged in the same manner as the unfolded sheets or small-sized sheets.

Also in such conventional apparatus, the processing conditions such as the sheet discharge speed to the tray, initial position of tray, lowering method of tray etc. are predetermined and not adjustable, so that the stacking performance and the matching with the preceding unit are often not satisfied, eventually resulting in dropping or jamming of sheets.

SUMMARY OF THE INVENTION

In consideration of the foregoing, an object of the present invention is to provide an improved sheet post-processing apparatus.

Another object of the present invention is to provide a sheet post-processing apparatus enabling satisfactory sheet stacking regardless whether the sheets are folded or not.

Still another object of the present invention is to provide a sheet post-processing apparatus capable of enabling satisfactory sheet stacking without sacrificing the throughput.

Still another object of the present invention is to provide a sheet post-processing apparatus capable of stacking sheets always under appropriate conditions.

The foregoing and still other objects of the present invention, and the advantages thereof, will become fully apparent from the following description which is to be taken in conjunction with the attached drawings.

BRIEF DESCRIPTION OF THE DRAWINGS

FIGS. 4—1 to 4—3 are detailed views of sorting trays of the finisher;

FIGS. 10-1 to 10-3, 11-1 to 11-5 and 12-1 to 12-3 are schematic views showing the modes of discharge and stacking of sheets onto the sorting tray.

DETAILED DESCRIPTION OF THE PREFERRED EMBODIMENTS

Figure 1:
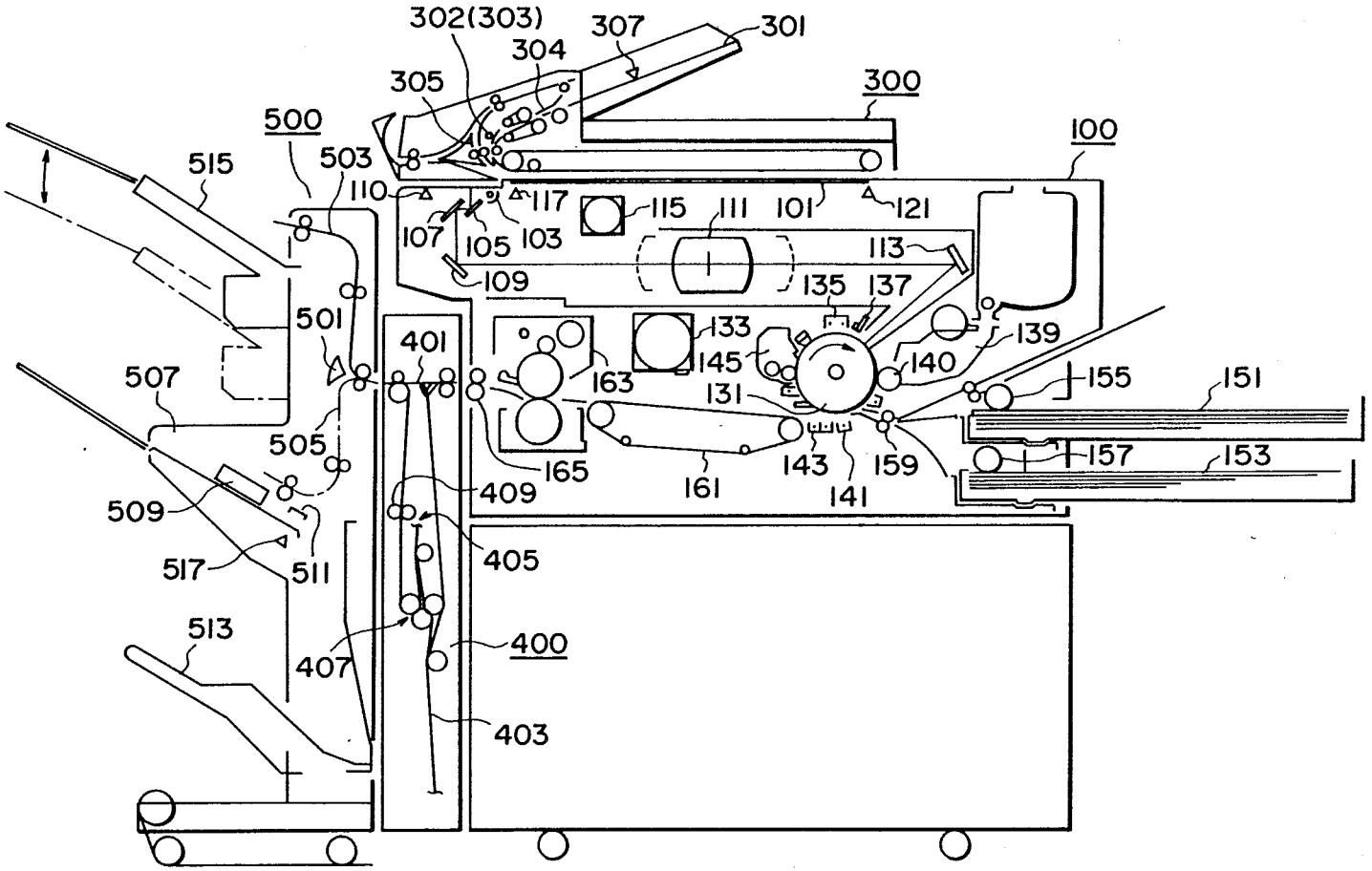
FIG. 1 is a view of internal structure of an image recording apparatus in which a sheet folding unit and a finisher unit are connected to a copying machine.

FIG. 1 shows the internal structure of an image recording apparatus embodying the present invention. There are provided a main unit 100 having an image reading function and an image recording function; a recycling document feeder (RDF) 300 for automatic feeding of original documents; a sheet folding unit 400 for folding the sheets at a predetermined position, and a finisher 500 (post-processing unit) having a sorting function and a stapling function, and said units 300–500 may be combined in an arbitrary manner with the main unit 100.

A. Main unit (100)

In the main unit 100 there are provided a glass plate 101 for supporting the original document; an illuminating (exposure) lamp 103 for illuminating the original; scanning mirrors 105, 107, 109 for deflecting the optical path of the light reflected by the original; a lens 111 for focusing and for varying image magnification; a fourth scanning mirror 113 for deflecting the optical path; a motor 115 for driving the optical system; and sensors 117, 119, 121.

There are further shown a photosensitive drum 131; a main motor 133 for driving said drum 131; a high voltage unit 135; a blank exposure unit 137; a developing unit 139; a developing roller 140; a transfer charger 141; a separating charger 143; and a cleaning unit 145.

There are further shown an upper cassette 151; a lower cassette 153; sheet feeding rollers 155, 157; registration rollers 159; a conveyor belt 161 for transporting a recording sheet, bearing recorded image thereon, toward a fixing unit; and a fixing unit 163 for image fixation by heat and pressure of the image on the transported recording sheet.

The above-mentioned photosensitive drum 131 is provided, on the surface thereof, with a seamless photosensitive member composed of a photoconductive member and a conductive member, and, being rotatably supported, is rotated in the direction indicated by an arrow by the main motor 133 activated in response to the actuation of a copy start key to be explained later. When a pre-processing of the drum 131, consisting of a pre-rotation control and a potential control, is completed, the original placed on the glass plate 101 is illuminated by the illuminating lamp 103 composed integrally with the first scanning mirror 105, and the light reflected from said original is guided through the first scanning mirror 105, second scanning mirror 107, third scanning mirror 109, lens 111 and fourth scanning mirror 113, and is focused on the drum 131.

The drum 131 is subjected in advance to corona charging by the high voltage unit 135, and then to slit exposure of the original image illuminated by the lamp 103, thereby forming an electrostatic latent image thereon.

The latent image on the photosensitive drum 131 is then developed into a visible toner image by the developing roller 140 of the developing unit 139, and said toner image is transferred onto a recording sheet by means of the transfer charger 141 as will be explained later.

The recording sheet in the upper cassette 151 or the lower cassette 153 is fed by the feed roller 155 or 157 into the main unit, and advanced by the registration rollers 159 toward the photosensitive drum 131 with such exact timing that the front end of said sheet coincides with that of the latent image. The toner image on the drum 131 is transferred onto said sheet while it passes between the drum 131 and the transfer charger 141. After said image transfer, the sheet is separated by the separating charger 143 from said drum 131, then guided by the conveyor belt 161 to the fixing unit 163, subjected to image fixation by pressure and heat, and discharged from the main unit 100 by the discharge rollers 165.

The drum 131 after said image transfer continues to rotate, and is subjected to surface cleaning by the cleaning unit 145 composed of a cleaning roller and an elastic blade.

B. RDF (Recycling document feeder) (300)

The RDF 300 is provided with a stacker tray 301 for setting the originals, and sensors 302, 303 for detecting the original size, positioned with a predetermined distance perpendicular to the advancing direction of the original. The transversal size of the original can be identified by whether the original is detected by both sensors 302, 302 or by a sensor 303 only. Said sensor 303 is assumed to be positioned at the back side of the drawing. More precise size detection is possible by increasing the number of such sensors. Also the longitudinal size can be detected from the duration of original detection of the sensor 303 (or 302).

The RDF 300 can stack the originals, sent from the stacker tray 301 to the exposure position through a sheet path 304, again on said stacker tray 301 by recycling through a sheet path 305. A sensor 307 detects a recycling of the originals.

The functions of the RDF 300 are detailedly described in the Japanese Pat. Application No. 206619/1984 of the present applicant, but will not be explained further since said functions are not directly related to the present invention.

C. Sheet folding unit (400)

The sheet folder 400 executes a half-folding for folding the sheet after recording approximately at the center thereof, or a Z-folding in which the sheet is folded in two places to obtain a Z-shape in cross section. The sheet folder 400 is provided with a flapper 401 for guiding the recording sheet downwards at the folding operation; sheet paths 403, 405; and folding rollers 407, 409.

When the Z-folding is selected by a Z-fold key to be explained later, the flapper 401 is activated to guide the sheet into the path 403, and, when the leading end of the sheet reaches the end of said path 403, the sheet is folded at a ¼ position by the rollers 407. When thus folded portion of the sheet reaches the end of the path 405, the sheet is again folded at a ½ position, and then the sheet is guided to the finisher 500 through the rollers 407 and the rollers 409. Also when the half-fold is selected by a half-fold key to be explained later, the sheet is half-folded in the path 403, and, without entering the path 405, is discharged to the finisher 500 through the rollers 409. On the other hand, when the sheet folding is not selected, the flapper 401 is not activated so that the recording sheet is directly discharged to the finisher 500.

D. Finisher (500)

The finisher 500 for sheet sorting or stapling is provided with a flapper 501 for selecting either a sorting path 503 or a stapling path 505; a stapling tray 507 for temporarily stacking the sheets to be stapled; a lateral aligning plate 509 provided on said stapling tray 509; a stapler 511 for stapling plural sheets aligned by said aligning plate 509; and a stacker tray 513 for stacking thus stapled recording sheets. Said lateral aligning plate 509 is driven by an unrepresented stepping motor. A sorting tray 515 is provided for sorting the unstapled sheets.

The sheets discharged from the main unit 100 are half-folded or Z-folded in the sheet folder 400 as selected, and is discharged either to the movable sorting tray 515 of the finisher 500 or to the stapling tray 507. The sheets guided to the stapling tray 507 are aligned, in a set of predetermined number, by the aligning plate 509, then bound by the stapler 511 and discharged to the stacker tray 513.

When a stapling mode is selected by a stapling key to be explained later, the flapper 501 is activated to guide the recording sheets to the stapling tray 507 through the path 505. When the number of the sheets reaches a pre-selected number, the aligning plate 509 and the stapler 511 are activated by an instruction from the main unit 100 to bind said sheets Then the stapled sheets are discharged to the stacker tray 513. Plural sets of collated and stapled copies are obtained by repeating the above-explained procedure. A sensor 517, for example a reflective sensor, is provided for detecting the presence of staples in the stapler.

When the stapling mode is not selected, the flapper 501 is turned off so that the sheets are discharged to the sorting tray 515 through the path 503. In response to an instruction from the main unit 100, said tray may be swayed laterally for example by 30 mm, at every suitable number of sheets, to stack the sheet in staggered fashion.

E. Operation keys

Figure 2:
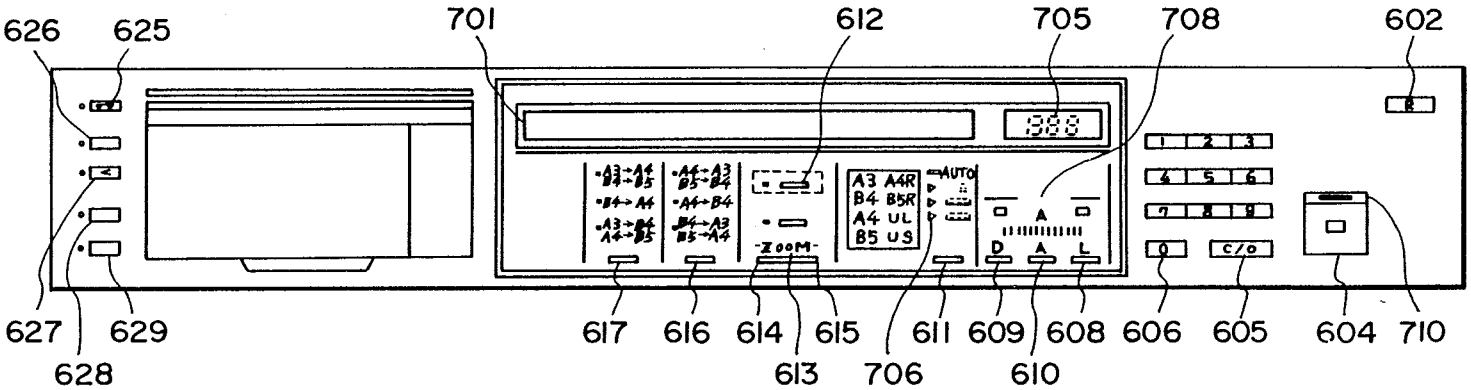
FIG. 2 is a plan view of an operation-display unit of the copying machine.

FIG. 2 shows an example of an operation panel provided on the main unit 100 and having keys 600 and displays 700 to be explained in the following:

an all reset key 602 to be used for restoring a standard mode;

a copy start key 604 to be used for starting a copying operation;

a clear/stop key 605, functioning as a clear key in the stand-by state or a stop key during the copying operation, for cancelling the preset copy number or for interrupting a continuous copying operation. The copying operation is interrupted when a copying cycle, which is in progress when said key is actuated, is completed;

numeral keys 606 for setting the copy number;

copy density keys 608, 609 for manual control of copy density;

an automatic exposure (AE) key 610 for conducting automatic control of the copy density in response to the density of the original, or for cancelling the AE mode and selecting manual density control;

a cassette selection key 611 for selecting the upper cassette 151 or the lower cassette 153, or an automatic paper selection (APS) mode for selecting the recording sheet of a same size as that of the original, when originals are present on the RDF 300;

a same size key 612 for obtaining a copy of a size same as that of the original;

an auto size change key 613 to be used for automatically enlarging or reducing the original image according to the selected sheet size;

zoom keys 614, 615 to be used for selecting an arbitrary image magnification within a range from 64 to 142%;

fixed size change keys 616, 617 for image enlargement or reduction between certain fixed sizes;

a staple key 625 to be used when the recording sheets are to be stapled;

a Z-fold key 626 for Z-fold of A3- or B4-sized sheet;

a half-fold key 627 for half-fold of A3- or B4-sized sheet;

a sorting key 628, which is lighted in the standard mode when the sorting tray 515 is connected, to be used for cancelling the sorting mode or restoring said mode; and a group key 629 for making plural copies from each original and storing the copies in different bins of the sorter 515 when it is connected.

F. Displays (700)

In FIG. 2, a liquid crystal message display 701 is capable of displaying 40 characters, each composed for example of 5×7 dots.

A copy number display unit 705 displays the number of copies or a self-diagnosis code. A cassette display 706 indicates whether the upper cassette 151 or the lower cassette 153 is selected.

An AE display unit 708 is lighted when the AE (automatic exposure) mode is selected by the AE key 610.

A ready/wait display unit 708 is composed of a two-color light-emitting diode of green and orange, and is lighted in green color in the ready state (copying operation enabled) or in orange color in the waiting state (copying operation disabled).

G. Control unit (800)

Figure 3:
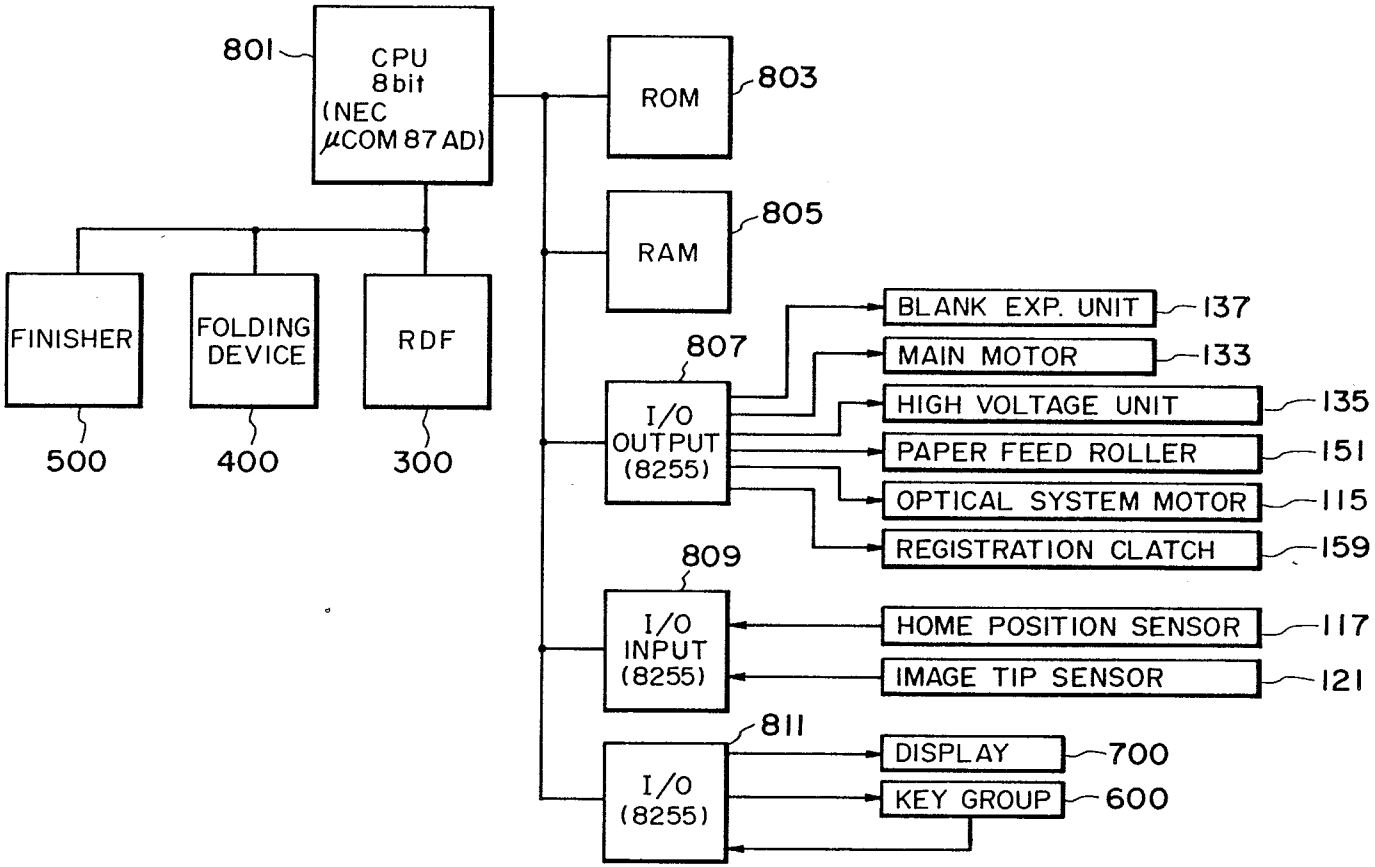
FIG. 3 is a block diagram of a control unit of the image recording apparatus shown in FIG. 1.
Figure 6A:
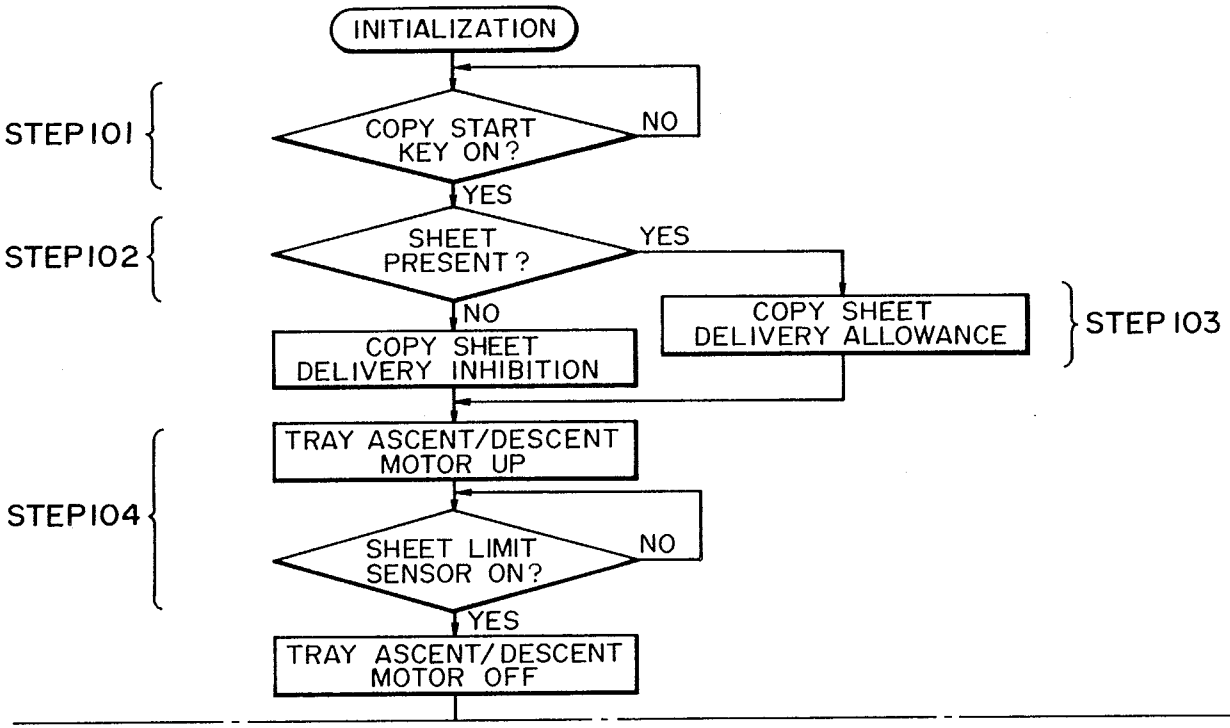
FIGS. 6, consisting of FIGS. 6A and 6B, 7-1, consisting of FIGS. 7-1A and 7-1B, 7-2, consisting of FIGS. 7-2A and 7-2B, 8 and 9 are flow charts showing the control sequence of the present invention.
Figures 6, 6B:
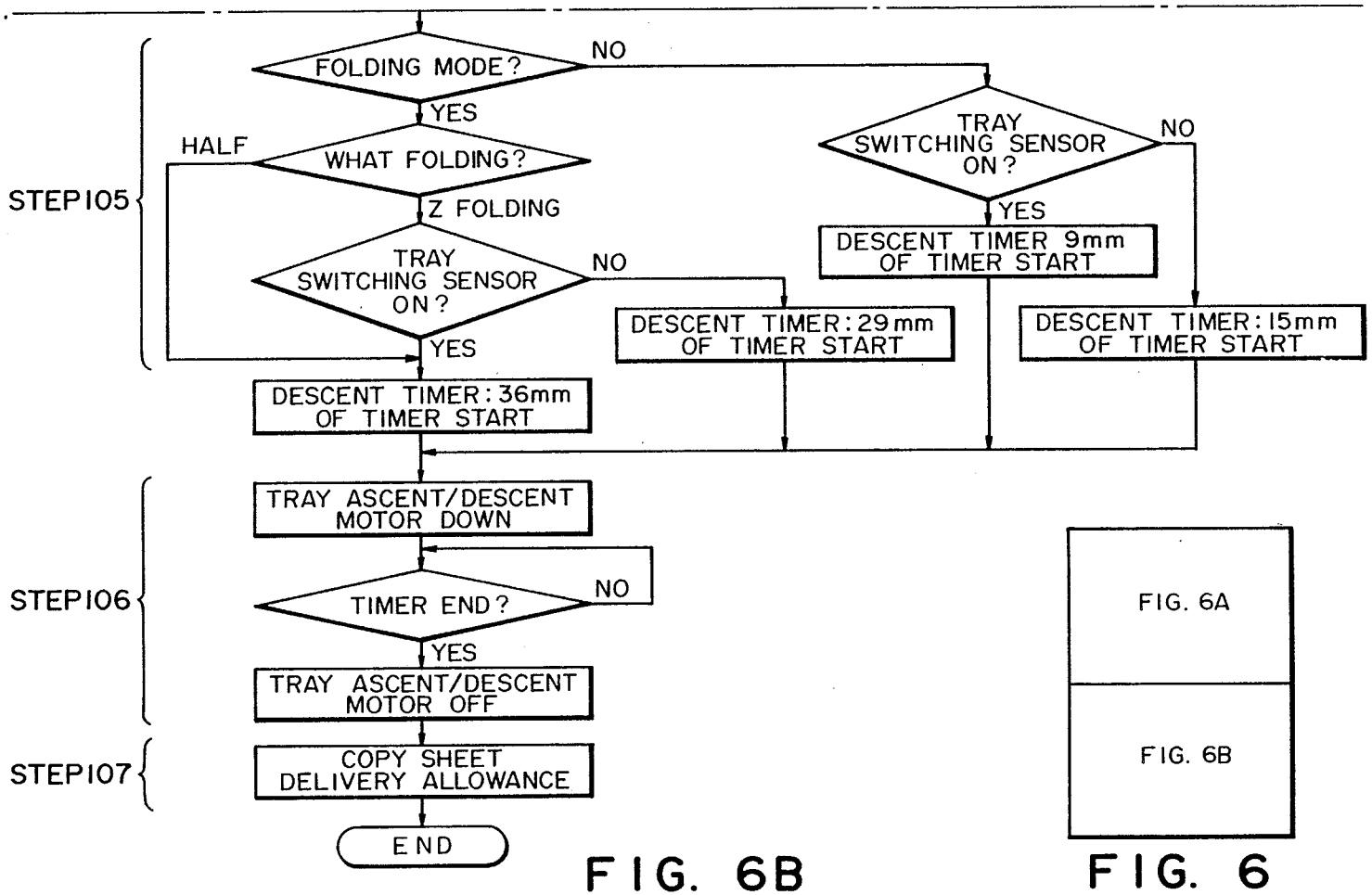

FIG. 3 is a block diagram of a control unit 800 employed in the embodiment shown in FIG. 1. A central processing unit (CPU) 801 for executing the control sequence of the present invention is composed for example of a microcomputer μCOM87AD manufactured by Nippon Electric Co. A read-only memory (ROM) 803 stores control programs as shown in FIG. 6 and ensuing drawings, and the CPU 801 controls the components connected thereto through a bus, according to the control sequences stored in said ROM. A random access memory (RAM) 805 constitutes a main memory for storing the input data and for functioning as a work memory area.

There are also provided an interface (I/0 port) 807 for supplying the control signal from the CPU 801 to loads such as the main motor 135; an interface 809 for supplying input signals for example from the image front end sensor 121 to the CPU 801; and an interface 811 for input/output control of the keys 600 and displays 700. Said interfaces 807, 809 and 811 are composed for example of an input/output port μPD8255 manufactured by Nippon Electric Co.

The displays 700 correspond to those shown in FIG. 2 and are composed of LED's and LCD's. The keys 600 correspond to those shown in FIG. 2, and the CPU 801 can identify the actuated key through a known key matrix.

The CPU 801 is also connected, through a bus line, to the RDF 300, sheet folder 400 and finisher 500 for controlling these units.

Example of function

Figures 1, 4:
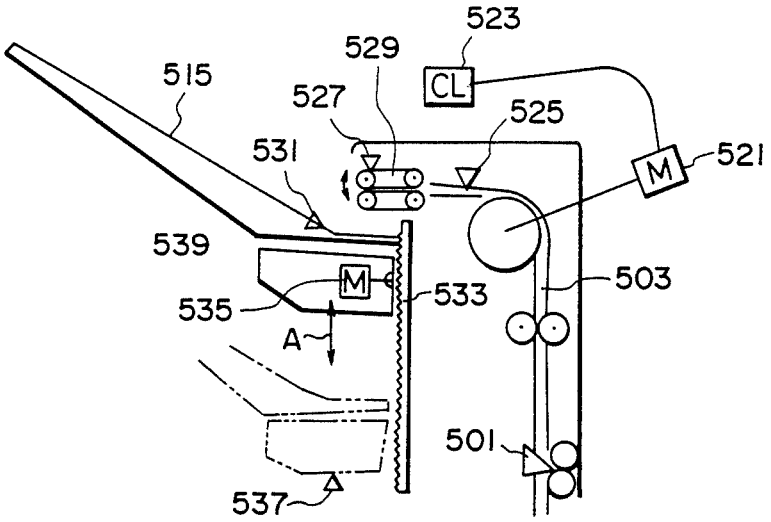
Figures 2, 4:
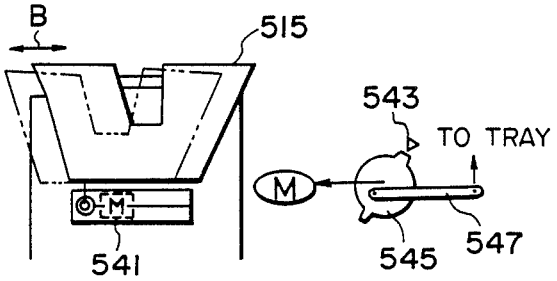
Figures 3, 4:
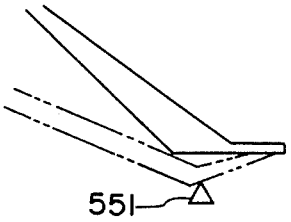

FIGS. 4-1 to 4-3 are detailed views of the sorting tray of the present embodiment.

In FIG. 4-1, the flapper 501 is so positioned as to guide the sheet upwards, whereby the sheet is discharged to the sorting tray 515 through the path 503 and a discharge belt 529. Transport rollers in the path 503 are all driven by a transport motor 521. The leading end of a sheet introduced into the path 503 by the flapper 501 is detected by a discharge sensor 525, in response to which the discharge belt 529 is activated by the motor 521 through a clutch 523 with a same transport speed as that of other transport rollers in the path 503, so that the sheet passes said discharge belt 529 with said transport speed. When the sensor 525 detects the rear end of the sheet, said clutch is turned off to reduce the transport speed, and the rear end of the sheet is kicked off from the belt 529 onto the tray 515 with said reduced speed. Said belt 529 is vertically movable, as indicated by an arrow, about an end thereof, and a sheet limit sensor 527 is positioned for detecting the upper limit when said belt is pushed up by the stacked sheets or at the initial tray position.

The sorting tray 515 is provided with a sheet detecting sensor 531 for detecting the presence of stacked sheets on said tray. Also said tray can have two different inclination angles as shown in FIG. 4-3, and is provided with a tray switching sensor 551 for detecting the smaller inclination angle of the tray.

Also a sorting tray unit 539 is rendered vertically movable by an elevating motor 535 and a rack and a pinion 533 as indicated by an arrow A, and the descending motion is terminated at the lower limit by a lower limit sensor 537.

Also the sorting tray unit 539 is horizontally movable in two positions as indicated by an arrow B in FIG. 4-2. The tray 515 performs a parallel movement by a shift motor 541 through a cam 545 and an arm 547, and said movement is controlled by deactivating the shift motor 541 when a shift position sensor 543 is actuated by a projection of the cam 545.

Figure 5:
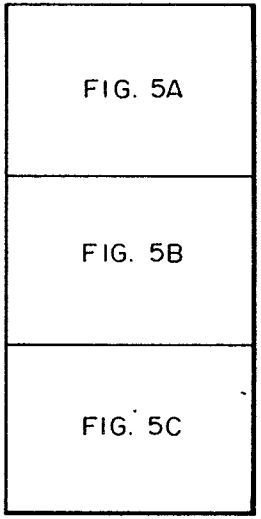
FIG. 5, consisting of FIGS. 5A, 5B, 5C, is a chart showing various operations.

Now reference is made to a function chart shown in FIG. 5 and flow charts shown in FIGS. 6 to 9, for explaining the details of function of the present embodiment.

(1) Initial function

If the stacking mode is selected when the copy start key of the main unit is actuated, the position of the sorting tray 515 has to be initialized according to the mode, as will be explained in the following, with reference to the flow chart shown in FIG. 6.

The sequence is started when the copy start key is actuated (step 101). A step 102 checks whether the sheet sensor 531 detects the presence of sheets on the tray 515, and the sequence proceeds either to a step 103 in the presence of sheets, or to a step 104, after the sheet discharge is prohibited as will be explained later, in the absence of sheets The step 104 activates the elevating motor to elevate the tray 515 until the sheet limit sensor 527 is activated, when said elevating motor 521 is turned off, whereby the tray 515 is brought to the uppermost position. A succeeding step 105 lowers the tray 515 according to the selected mode, as will be explained in the following.

The initial position of the tray 515 is different according to the folding mode. In the half-folding mode, the tray 515 is lowered to a position of a distance of 36 mm from said uppermost position (step 106). In the Z-fold mode, the descending distance of the tray 515 is different according to whether the tray switch sensor 551 is turned on, i.e. whether the tray 515 is in a more flattened position. Said distance is 36 mm or 29 mm from the uppermost position respectively when the switch sensor 551 is on or off. When the folding mode is not selected, said distance is 9 mm or 1.5 mm from the uppermost position respectively when said tray switch sensor 551 is on or off. The reason for varying the tray position according to the folding state or the tray angle will be explained later.

The above-explained tray initializing operation after the actuation of the copy start key is conducted when the sheet sensor 531 is off in the step 102. This will correspond to a case in which the stacked copies obtained in a preceding copying operation are removed from the tray 515, so that the tray will be in a considerably lowered position for stacking said sheets and will require a considerably long period for elevation. In such case, therefore, the discharge of copy sheets from the main unit is disabled for initializing the tray 515, and said discharge is enabled after the completion of said initialization (step 107). Such sequence is adopted since satisfactory sheet stacking on the tray is difficult to attain if the copy sheets are discharged before the tray 515 reaches the predetermined position.

On the other hand, if the sheet sensor 531 is on in the step 102, the step 103 enables the sheet discharge and the initializing operation is executed in the step 104 and ensuing steps. In this case the sheets stacked in the preceding copying operation remain stacked on the tray, so that the initialization is conducted for the uppermost position of said stacked sheets and thus requires a shorter time. Consequently the initialization can be sufficiently completed before the discharge of recording sheets, so that the discharge need not be prohibited as in the above-explained case. In this manner the copying time can be reduced.

(2) Sheet discharge operation

Figures 1A, 7:
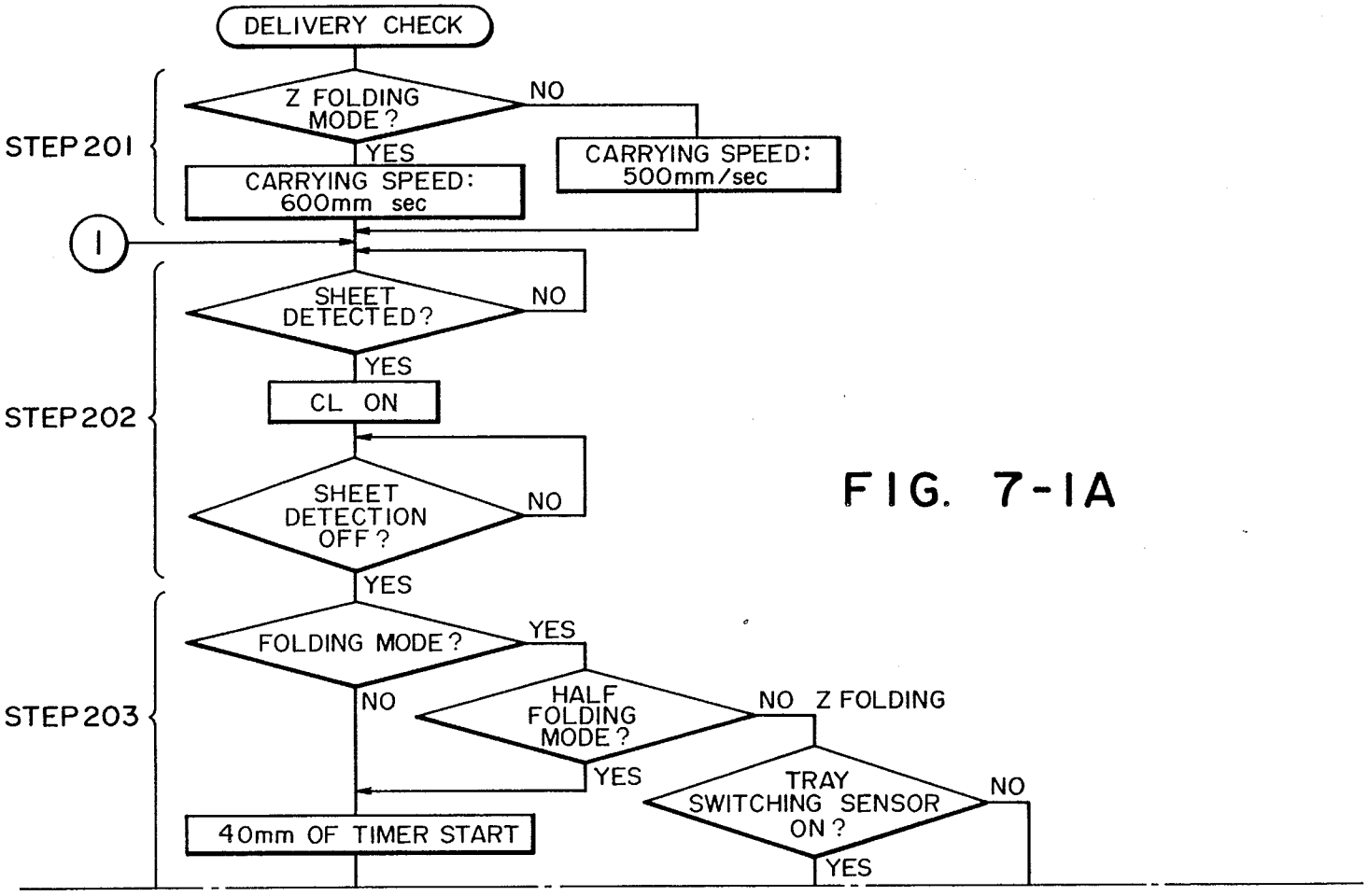
Figures 1, 1B, 7:
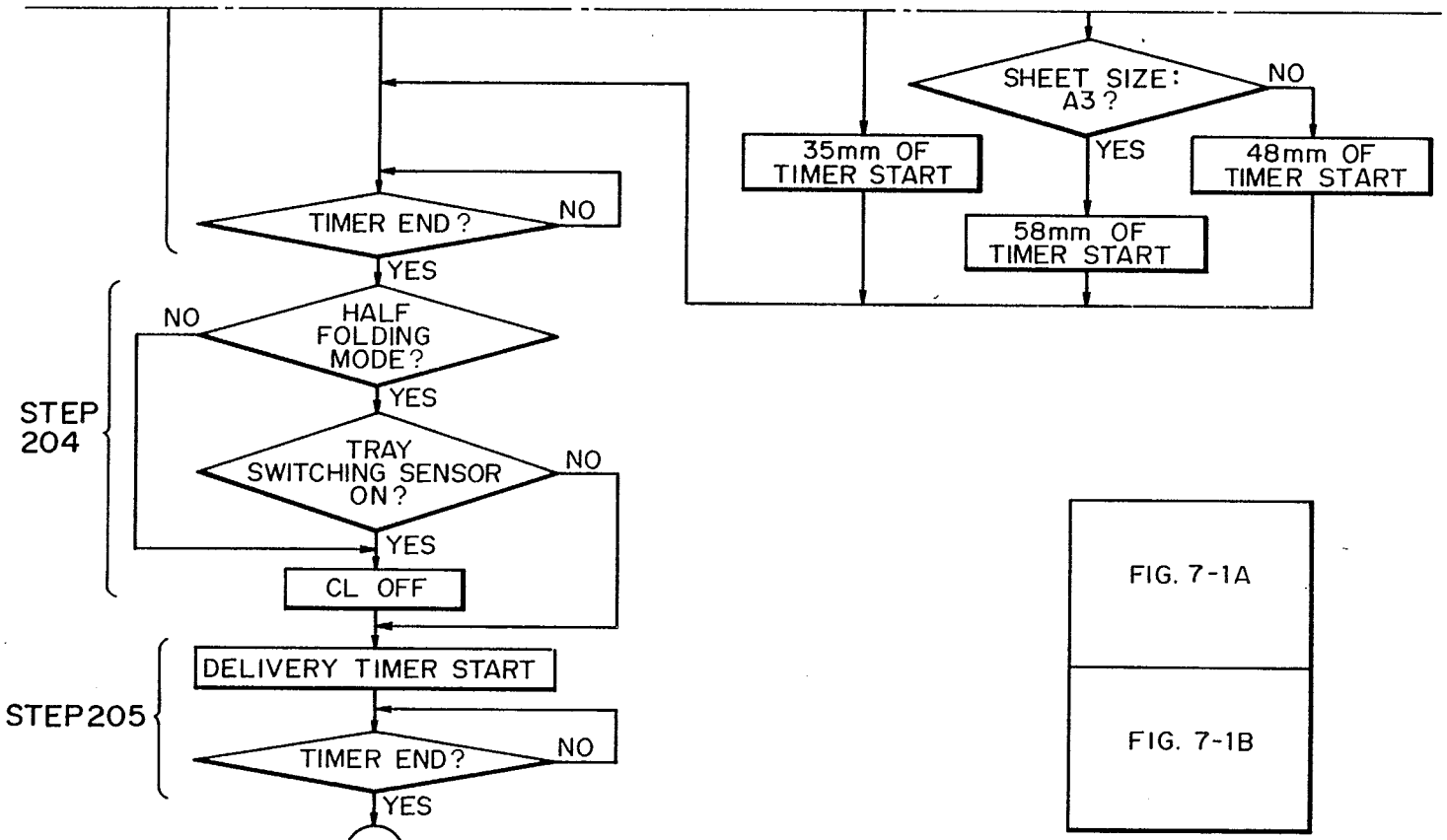
Figures 2A, 7:
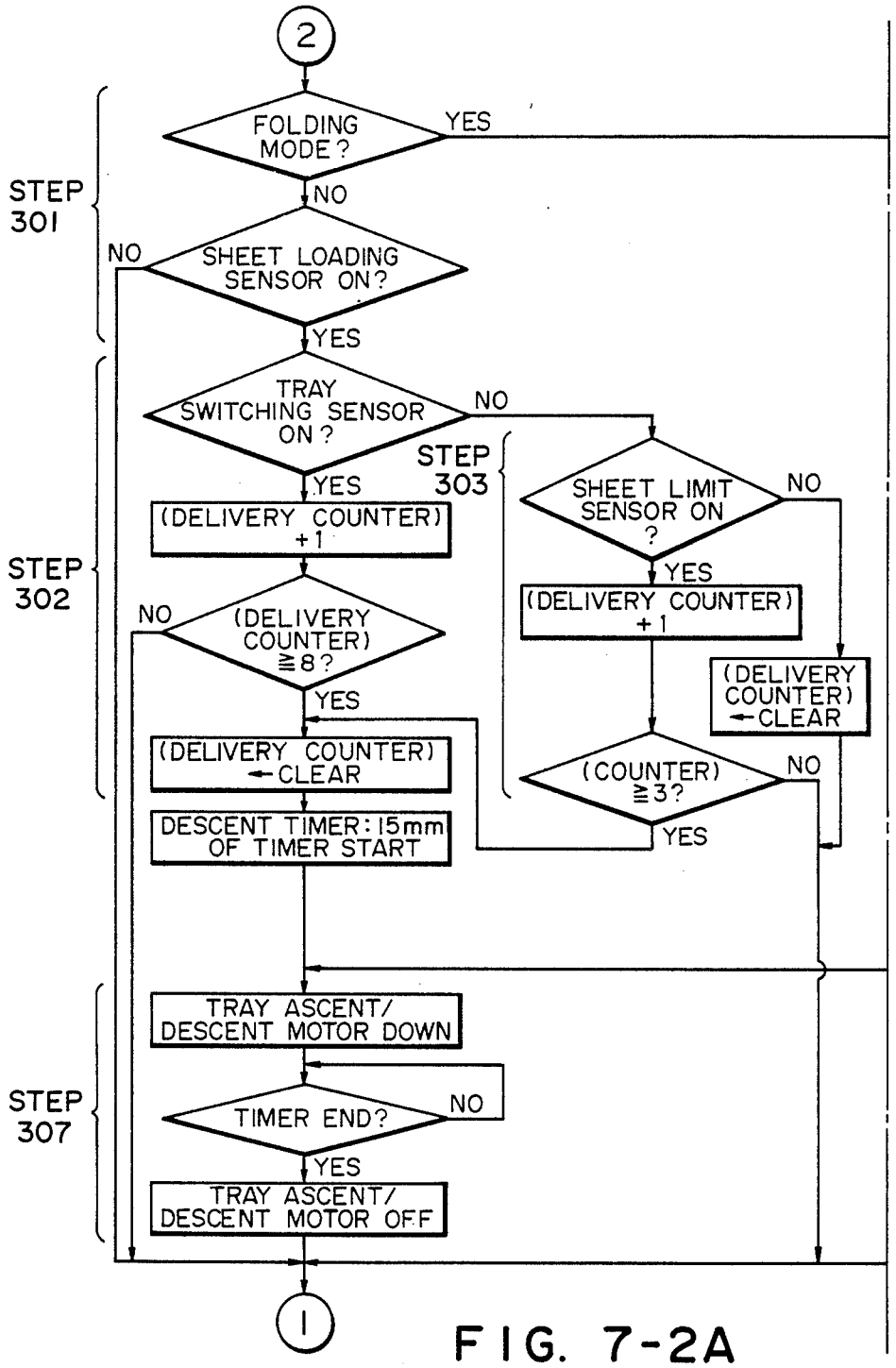
Figures 2, 2B, 7:
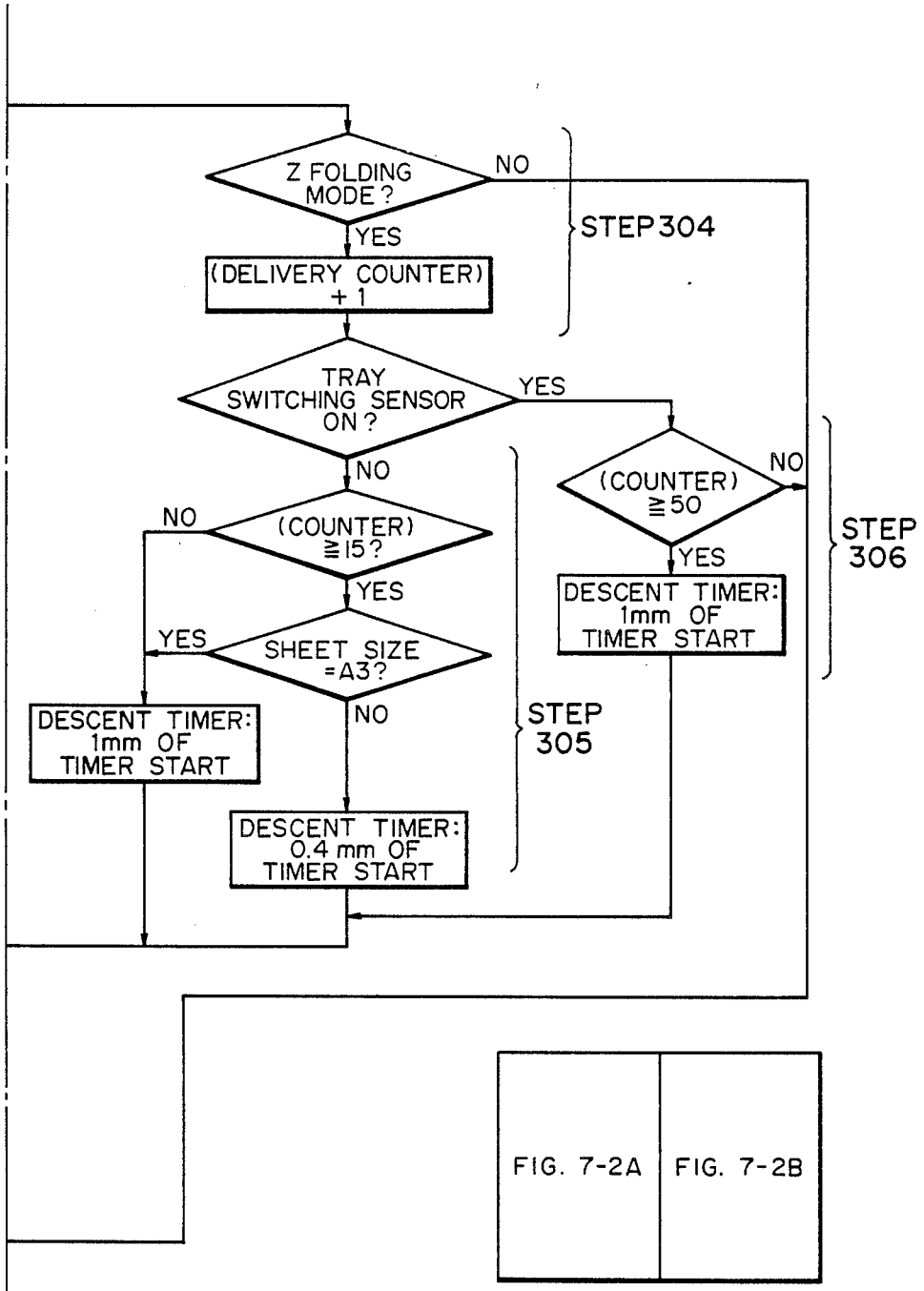
Figure 8:
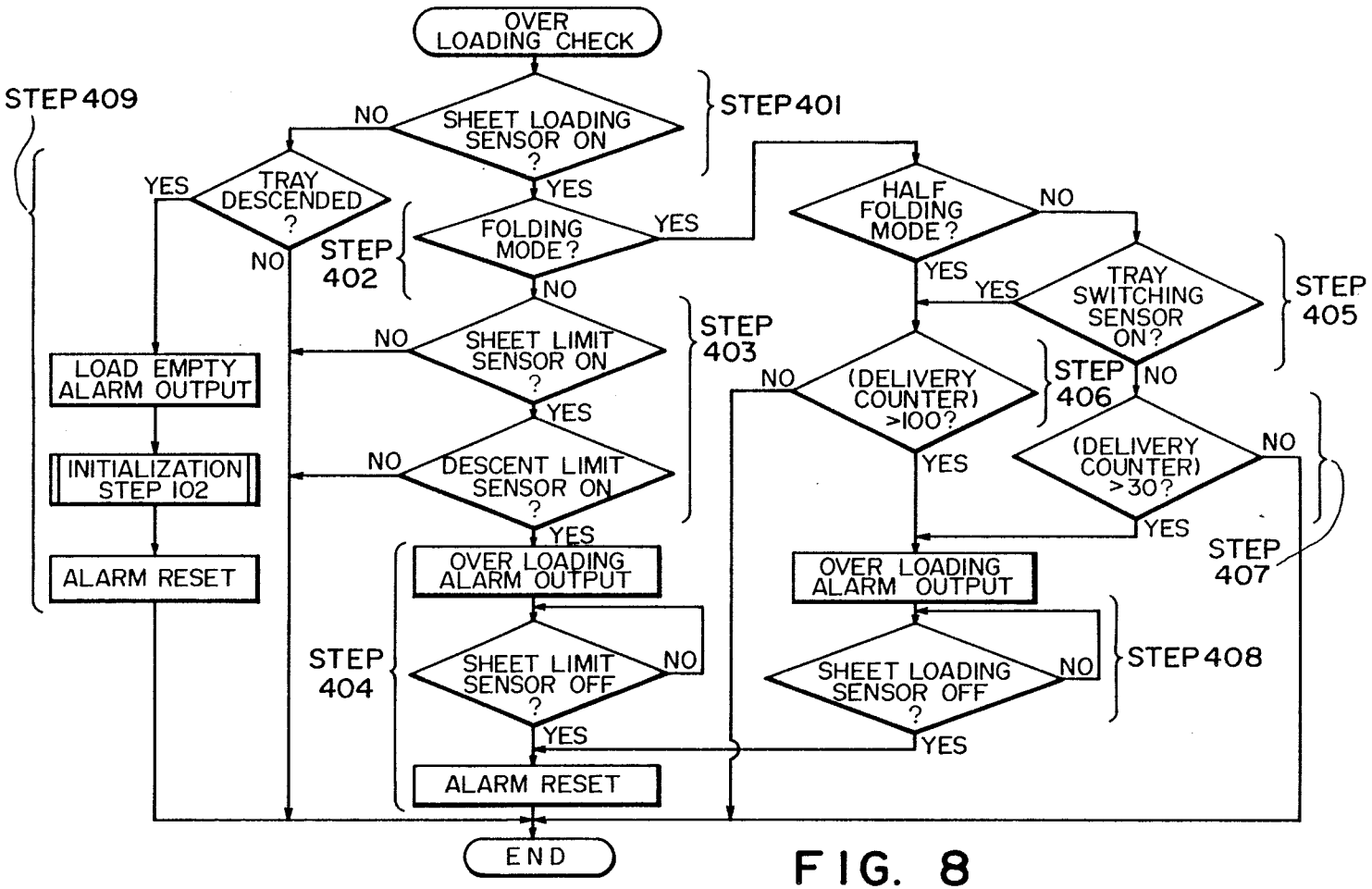

In the following explained are a sheet discharge sequence to the sorting tray 515 of the finisher and a sheet stacking sequence of said tray, while making reference to the flow charts shown in FIGS. 7-1 and 7-2.

The sheets discharged from the main unit are supplied, either through the folder 400 in a folding mode or through a through path in the non-folding mode, to the entrance of the finisher, and guided to the tray 515 through the path 503. At first a step 201 discriminates whether the Z-fold mode is selected, and controls the motor 521, for example by known phase-locked loop control, to obtain a transport speed of 600 mm/sec or 500 mm/sec respectively if the Z-fold mode is selected or not. Then a step 202 turns on the clutch 523 when the sheet arrives at the discharge sensor 525, thereby regulating the speed of the discharge belt 529 equal to the above-mentioned speed and enabling smooth discharge of the sheet until it passes through the sensor 525. Then steps 203, 204 turn off the clutch 523 after the sheet passes through the sensor 525, with a timing finely controlled according to the mode, to reduce the speed of the discharge belt 529 to about ¼ thereby achieving satisfactory discharge and stacking of the sheets. Particularly the discharge and stacking of the first sheet depend on the initial position of the tray and the transport speed, as will be explained in the following with reference to FIGS. 10-1 to 10-3.

Figures 1, 10:
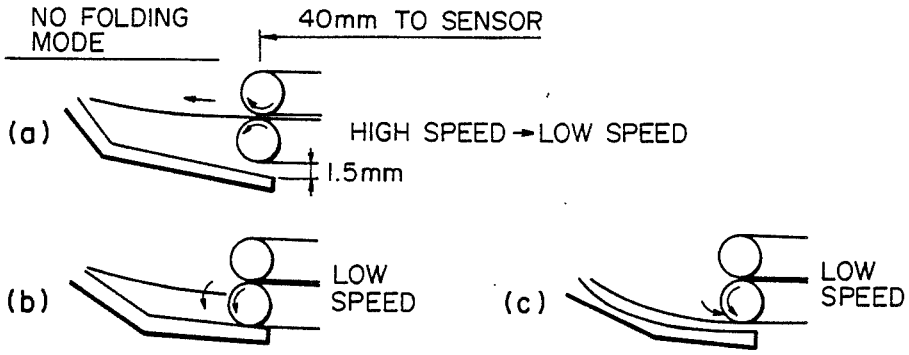
Figures 2, 10:
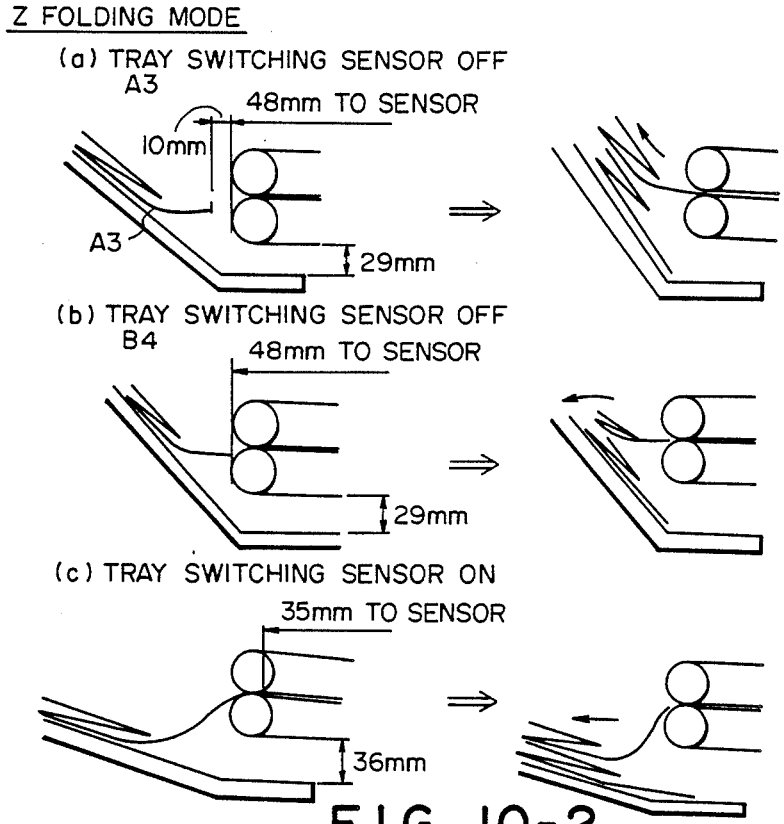
Figures 3, 10:
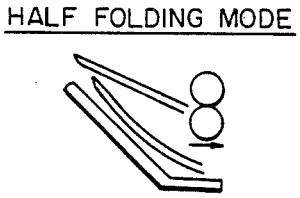

In the non-folding mode, the clutch 523 is turned off to reduce the transport speed when the rear end of the sheet reaches a position of 40 mm after the sensor 525. As shown in FIG. 10-1(*a*), said position corresponds to the center of a roller for driving the discharge belt 529, so that the sheet is transported with a high speed of 500 mm/sec to this position A sheet curling caused by the rigidity of sheet can therefore be prevented Also the sheet discharged is conducted at the lowered speed, with the rear end contacting the belt as shown in (*b*), without an excessive sheet kicking as shown in (*c*). Since the tray is positioned below the belt with a gap of 1.5 mm, the sheets are pulled in under the belt and satisfactorily stacked on the tray. There can therefore be achieved satisfactory sheet stacking without limiting the sheet discharge from the main unit to the finisher and without reducing the copy speed of said main unit, by transporting the sheet at a high speed for the length of sheet and reducing the transport speed for a certain short distance in the discharge.

In the Z-fold mode, the timing of turning off the clutch 523 is varied according whether the tray is in the lowered position and whether the sheet is A3-sized, as shown in FIG. 10-2. At first (*a*) shows a state with the tray in the upper position and with A3-sized sheets, in which the clutch 523 is turned off after the lapse of a time required for the sheet to travel 58 mm, from the turning off of the discharge sensor 525 by the sheet. This corresponds to a position 10 mm downstream of the left end of the discharge belt 529 in the sheet transport direction. The sheet is transported with a high speed 600 mm/sec to said position, in order to prevent the deformation of sheet at the boundary between the overlapping portion and the unoverlapping portion of Z-folded sheet. The rear end of the sheet is made to drop slowly at a position 10 mm distant from the end of the belt 529, by turning off the clutch 523 to a lower transport speed, whereby the sheets can be satisfactorily stacked without misalignment at the rear end.

In the upper position of the tray with B4-sized sheets, the clutch 523 is turned off at a timing when the sheet passes through a position 48 mm distant from the turning off of the sensor 525, or a position at the left end of the discharge belt 529 as shown in FIG. 10-2 (*b*). Because the Z-folded B4-sized sheet is shorter than the Z-folded A3-sized sheet, a high-speed distance to the distance of 58 mm as in the above-explained case for A3-sized sheet will cause an excessively long flight beyond the Z-folded sheets stacked on the tray 515, so that satisfactory stacking cannot be obtained. Consequently said distance is shortened to 48 mm, which provides satisfactory result, and the misalignment at the rear end still does not occur since the sheet is shorter.

In these Z-folding modes, the tray is positioned at 29 mm below the discharge belt to extend the distance of flight of the leading end of Z-folded sheet before colliding with the tray thereby preventing the deformation of sheet in the high-speed sheet discharge, and to prevent the engagement of the discharged sheet with the Z-fold of the preceding sheet.

In the lower position of the tray 515, the tray is positioned at a distance of 36 mm from the discharge belt 529 and the clutch 523 is turned off at a timing when the sheet is at a position of 35 mm from the turning off of the sensor 525 or of 13 mm in front of the left end of the discharge belt 529, regardless of the sheet size. When the tray is in the lower position as shown in FIG. 10-2(*c*), it is no longer necessary to extend the flight of sheet by extending the high-speed discharge as in the upper position of the tray, but is preferable to use low-speed discharge at the rear end of the sheet to achieve secure stacking. Also the tray is amply lowered in this case to achieve sheet stacking with a wide tolerance, without the above-mentioned sheet engagement.

Again referring to FIG. 7-1, in case the tray 515 is in the upper position in the half-fold mode, a step 204 does not turn off the clutch 523 to conduct high-speed discharge, and separates the tray by a distance of 36 mm from the discharge belt as in the step 105 in FIG. 6 to avoid undesirable catching of the rear end of sheet by the belt 529, thereby achieving satisfactory sheet stacking Icf. (FIG. 10-3).

In the following there will be explained the method of tray descent in the course of sheet discharge and stacking in different modes. A step 205 in FIG. 7-1 activates a discharge timer to wait for a period required for each sheet to be discharged and stacked completely The subsequent function is different according to the selected modes, mainly depending on whether a folding is selected or not, as shown by a sequence starting from a step 301 in FIG. 7-2. At first there will be explained the operation in the non-folding mode.

The step 301 checks the state of the sheet sensor 531, and, if it is off, the tray 515 is not moved. In this state it is assumed that the operator has removed the discharged sheet one by one as it is discharged. On the other hand, if said sensor is on, a step 302 checks the state of the tray switch sensor 551. If the sensor is on, indicating the lower position of the tray, the number of discharged sheets is counted, and the tray is lowered at a rate of 1.5 mm for every 8 sheets. In this case, 1.5 mm is assumed to be equal to the thickness of 8 sheets, and, since the tray is lowered by 9 mm in advance in the step 105 in FIG. 6, stacking level of sheets can be maintained approximately constant, without contact of the discharge belt 529 with the stacked sheets. On the other hand, when the tray is at the upper position, a step 303 identifies a normal state, and, as the sheets are stacked up, the discharge belt 529 is eventually pushed up by the stacked sheet and activates the sheet limit sensor 527. The tray is lowered by 1.5 mm after the activation of said sensor continues for the discharge of three sheets, in order to prevent shattering of the sensor. Satisfactory stacking of a large amount of sheets is enabled by repeating the above-explained operation.

Figures 1, 11:
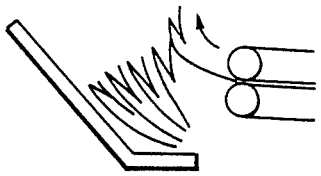
Figures 2, 11:
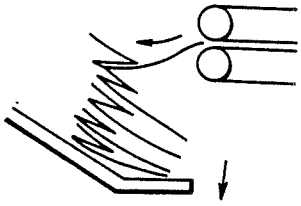
Figures 3, 11:
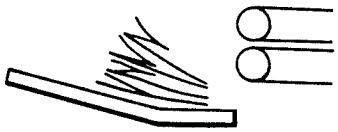
Figures 4, 11:
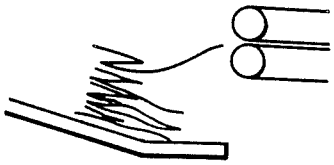
Figures 5, 11:
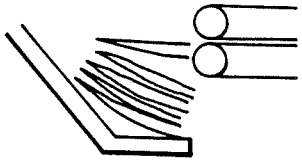

On the other hand, Z-fold mode (step 304) requires a different tray descending operation different from the case of non-folded mode explained above, because Z-folded sheets tend to heap up in the Z-folded portion when stacked as shown in FIG. 11-1 and are difficult to stack in satisfactory manner. Therefore, when the tray is in the upper position, a step 305 is executed to lower the tray by 1 mm for each discharged sheet up to 14th discharged sheet, and, for 15th and succeeding sheets, by 1 mm for each A3-sized sheet or by 0.4 mm for each B4-sized sheet. This operation corresponds to the step 203 shown in FIG. 7-1, for always placing the uppermost stacked sheet at an appropriate position (angle and height) with respect to the next discharged sheet, in order to prevent the jumping, mutual engagement, misalignment of the rear end etc. of the Z-folded sheets. If the height of tray is not changed, a newly discharged sheet will jump over the already stacked sheet as shown in FIG. 11-1, but satisfactory stacking can be achieved if the tray is lowered as shown in FIG. 11-2. On the other hand, if the tray is in the lower position, a step 306 is executed. In this case the descending of the tray can be done in a less precise manner, because the heaping of Z-folded sheets is smaller as shown in FIG. 11-3. Consequently the tray is not moved up to the 49th sheet, and is lowered by 1 mm for each discharged sheet starting from the 50th sheet (FIG. 11-4).

On the other hand, half-folded sheets can be satisfactorily stacked without the descent of the tray, as the tray is lowered in the initial state as shown in FIG. 11-5.

(3) Checking of overstacking

In the foregoing there has been explained the control for achieving satisfactory sheet stacking on the tray, but it is finally necessary to stop the apparatus in order not to exceed the upper limit of stacking. In the following there will be explained the upper limit and the cancelling of stoppage of operation in different modes. A step 401 confirms the presence of stacked sheets by the sheet stacking sensor 531 as explained before, and, in the presence of stacked sheets, a step 402 checks the mode to select different processes. A step 403 is a stacking limit check for the non-folded mode. In this case the tray is lowered in succession as explained before, until a lower limit sensor 537 is activated. The upper limit is identified when the stack reaches a level of activating the sheet limit sensor 527 in this state, and an overstacking alarm is released. In this case, therefore, the stacking overflow is detected from the height of the stacked sheets. Said alarm can be reset when the operator removes the upper part of the stacked sheets to turn off the sheet limit sensor 527 (step 404).

On the other hand, in the folding modes, the stacking limit is defined by the number of sheets. An alarm is released at the 100th discharged sheet in the half-fold mode or in the Z-fold mode with the tray at the lower position, or at the 30th sheet in the Z-fold mode with the tray at the upper position (steps 406, 407).

In these modes the upper limit has to be determined by the number of sheets, because the height of stack of folded sheets is difficult to define as already explained in relation to the discharge check program.

The alarm in this state is reset when the operator removes all the stack of folded sheets to turn off the sheet stack sensor 531 (step 408). A step 409 checks erroneous removal of the stacked sheets by the operator in the course of a continuous operation. In such case the tray is already lowered by the height of the stacked sheets, so that satisfactory stacking cannot be expected if said sheets are removed. Thus the step 409 detects whether the tray has been lowered at least-once, and generates a stack empty alarm if the sheet stack sensor 531 is turned off after the tray has been lowered. In such case the above-explained initial routine starting from the step 102 is executed to return the tray to the initial position in respective mode, and then the alarm is reset.

In response to each alarm, the main unit interrupts the operation, and awaits the resetting of the alarm. The content of the alarm may be displayed on a display unit of the main unit.

(4) End check

In the following there will be explained a sorting operation, with reference to FIG. 9.

At first a step 501 awaits the discharge of the final sheet from the main unit, and starts the sorting operation according to the selected mode.

A step 502 detects whether a folding mode is selected, and, if selected, the sequence proceeds to a step 504. In a non-folding mode, the tray is lowered by a predetermined amount at the end of sheet discharge, and said amount is varied according to the on- or off-state of the tray switch sensor 551. This is to facilitate the removal of sheet by the operator since, in the non-folding mode, the lower end of the discharge belt 529 is maintained in contact with the stacked sheets as shown in FIG. 10-1. Also in the sorting mode to be explained later, the lateral shift of the tray will cause displacement of the uppermost sheet unless the tray is lowered, since the discharge belt is not moved. The amount of tray descent is selected as 10 mm or 18 mm respectively when the tray switch sensor is turned on or off, in order to lower the tray to a position completely free from contact with the discharge belt 529.

A step 504 shifts the tray by about 30 mm in lateral direction in the sorting mode, by activating the shift motor until the shift position sensor 543 is activated.

In the folding modes the tray is not lowered as in the step 503, because the tray is already in a lowered position in advance.

Such lateral shift of 30 mm in a state separate from the discharge belt enables satisfactory sorting of a set of copy sheets. In the step 504, the lateral shift of the tray is not conducted if the tray lower limit sensor 527 is turned on. When said sensor is turned on, the tray can no longer descend even if the uppermost sheet is in contact with the discharge belt, for example in the non-folding mode, and said prohibition of lateral shift is to prevent displacement of said uppermost sheet in such case.

As explained in the foregoing, the detection of upper limit of sheet stacking on the tray is made either by the height of stacked sheets or by the number thereof, according to the non-folding or folding mode, thereby ensuring secure sheet stacking and preventing eventual troubles such as sheet dropping.

Though not described in the foregoing embodiment, the upper limit for a mixed stack of folded sheets and non-folded sheets may be detected by the number of sheets, as said limit is difficult to detect by the height. In such case there may be provided, for example, counter means for counting, after the sheet stack sensor is activated, the number of each unfolded sheet as 0.5 sheets and each folded sheet as 1 sheet, and comparing the obtained count with the aforementioned upper count. Such weighted counting of folded and non-folded sheets allows to maximize the upper limit of such mixed stack without trouble.

In addition to the detection of upper limit, by height, of the non-folded sheet stack, there may simultaneously be counted the number of stacked sheets. If the height sensor for the sheet stack is broken, the apparatus will continue to stack the sheets beyond the upper limit, for example 1,500 sheets, because the height sensor is not turned on. Thus, if the height sensor is not turned on even after the obtained count exceeds a predetermined value, a sensor failure is identified and the operation of the apparatus is interrupted. In this case a display requesting a serviceman call for a machine failure should be given instead of a simple alarm for an overstacking.

Also at the start of a copying job, if the sheet sensor is turned on, indicating the presence of already stacked sheets on the tray, the uppermost level of the stack is close to the reference position, so that the time required for returning to the reference position is shorter than a predetermined time required for the discharge of a sheet after the start of copying operation. Consequently the tray is already at the reference position when the first sheet is discharged to the tray, thus ensuring satisfactory stacking. Also the entire throughput is improved as the initializing time can be shortened. On the other hand, when the sheet sensor is turned off, it is anticipated that the tray is already considerably lowered and cannot be initialized with said predetermined time for sheet discharge. In such case the sheet discharge is enabled only after the tray is securely brought to the home position, thus preventing troubles such as sheet dropping.

Also there may be provided an improved embodiment in the following manner. In the foregoing embodiment, the sheet discharge is prohibited until complete elevation of the tray to the upper limit position. However, since a certain time is required before a sheet can be discharged from the recording apparatus, satisfactory sheet stacking can be achieved if the sheet discharge to the tray can be synchronized with the completion of elevation of the tray. Thus the entire throughput can be improved by cancelling the prohibition of sheet discharge prior to and in consideration of said certain time. It is rendered possible to determine the timing of cancelling the prohibition of sheet discharge in secure manner, by providing counter means for accumulating the amount of descent of the tray from the home position and means for calculating, from the data of said counter means, the time required for the tray to return to the home position after the sheets are removed therefrom. In such case the positional calculation is naturally different between the folding mode and the non-folding mode.

In the foregoing mode, the transport means and clutch means are controlled, at the position of sheet discharge onto the tray, according to the presence or absence of sheet folding and the sheet size to realize different discharge speeds, thereby enabling satisfactory sheet stacking and preventing troubles such as sheet dropping.

Also the amount of descent of tray during sheet stacking and the timing thereof are likewise controlled according to the presence or absence of sheet folding and sheet size to achieve similar effects.

It is furthermore possible, at the start of a copying job, to effect an ordinary copying operation if sheets are absent on the sorting tray, but, if sheets are present on said tray, to effect the copying operation if the sheet processing form is same as that in the preceding copying job and to prohibit the copying operation otherwise.

Such embodiment will be explained in the following, with reference to FIGS. 12-1 to 12-3 and 13.

Figures 1, 12:
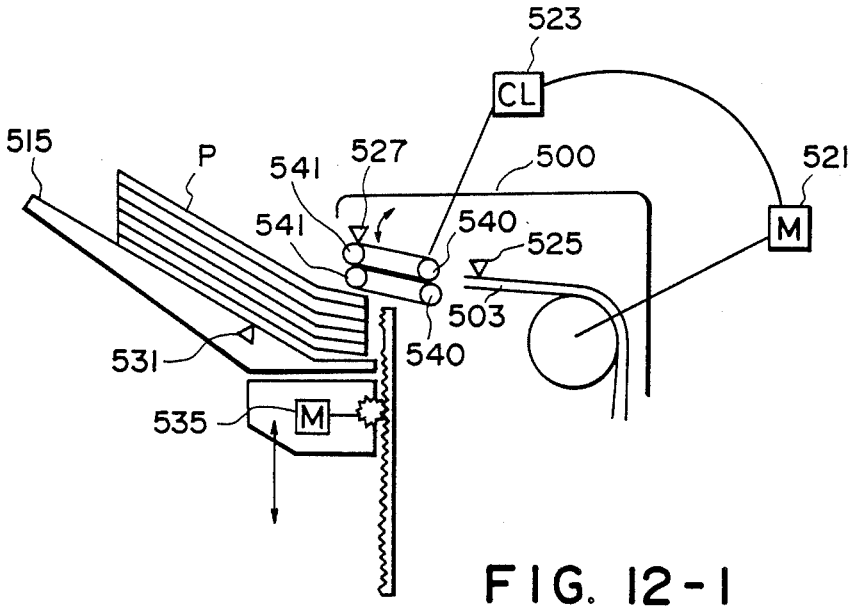
Figures 2, 12:
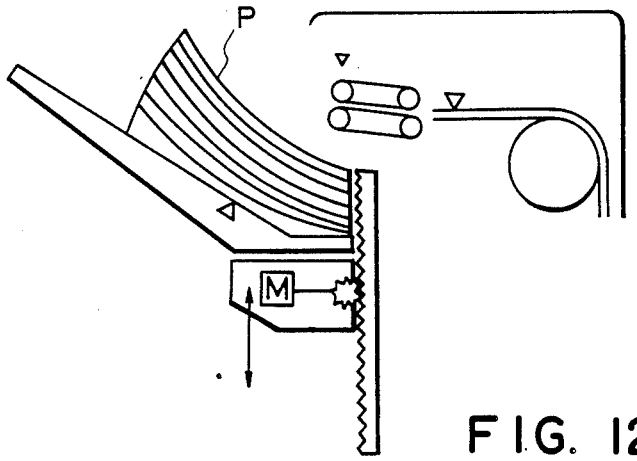
Figures 3, 12:
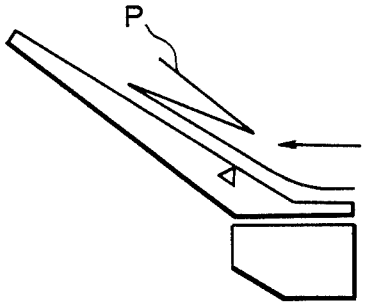

FIG. 12-1 shows a stack of ordinary sheets. Discharge rollers 541 are rendered rotatables, about rollers 540, vertically over a certain range, and the upper limit position is detected by an upper limit sensor 527. As the sheets are discharged onto a sort-tray 515, the rollers 541 are gradually pushed up by the stacked sheets and eventually activate the upper limit sensor 527. At this point a vertical motion motor 535 is activated to lower the sorting tray by a predetermined distance by means of illustrated rack and pinion. A large amount of sheets can be stacked by repeating the above-explained procedure. Said upper limit sensor 527 is used also for detecting the initial position of the sorting sensor at the start of a copying job. A stack sensor 531 is used for detecting the presence of sheets on the tray.

FIG. 12-2 shows a stack of folded sheets. Because of a heaped portion at the end, stacking of a large amount is difficult to realize in the above-explained control for ordinary sheets. For folded sheets, therefore, it is more effective to lower the initial position in advance (for example 40 mm below the initial position for ordinary sheets) by the motor 535 and to lower the sorting tray by a predetermined distance for a predetermined number of stacked sheets. If the sheet discharge for Z-folded sheet is conducted at the same height as for the non-folded sheets, a newly discharged sheet may be trapped in the Z-fold of the already stacked sheets as shown in FIG. 12-3.

The descent of tray during the stacking of non-folded sheets is controlled by the activation of the upper limit sensor 527 as explained before, but the tray descent for folded sheets is preferably conducted by a predetermined distance for a predetermined number of discharged sheets. For example the tray may be lowered by 2 mm for every 3 Z-folded sheets, or for every 5 half-folded sheets. Also the discharge speed of Z-folded or half-folded sheet onto the tray is preferably made somewhat larger than that of non-folded sheets, for example by regulating the speed of the motor 521, because the folded sheet has a larger air resistance and a larger sheet-to-sheet friction.

Figure 13:
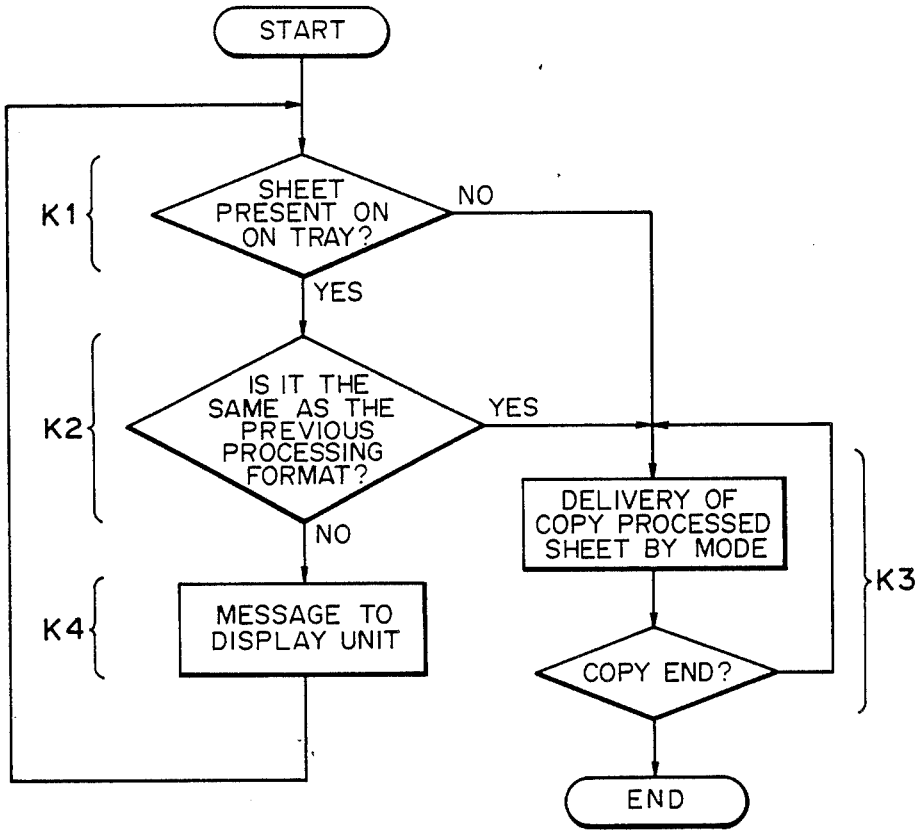
FIG. 13 is a flow chart showing the control sequence in another embodiment of the present invention.

In the following there will be explained the function of the present embodiment, while making reference to FIG. 13.

In response to the actuation of a copy start key, a step K1 causes the sheet sensor 531 to detect the presence of sheets on the tray, and, if present, a step K2 discriminates whether the sheet processing form in the new copying job is same as that in the preceding job. Said sheet processing form is selected by the keys 626, 627 in the operation unit 700 shown in FIG. 2, and said selection is stored in a predetermined area of the RAM 805 shown in FIG. 3. If the processing form is different, a step K4 displays a suitable message on the main unit. For example a message "REMOVE COPIES FROM THE TRAY" is given on the LCD unit 701 of the displays 700, and the copying job is started after the sheet sensor 531 confirms the removal of the copies. If the step K1 detects the absence of sheets on the tray, the sequence proceeds to start copying operation according to the selected mode. Also in the presence of sheets on the tray, if the step K2 identifies that the sheet processing form is same as that in the preceding job, the sequence proceeds also to the step K3 to conduct the copying operation.

In the present embodiment, the sheet discharge speed and the vertical tray motion are controlled according to the sheet processing form to constantly obtain stable stacking and alignment of sheets. Also at the start of a copying job, the operation is enabled or disabled according to the presence or absence of sheets on the tray and the sheet processing form thereof, so that stable sheet processing can be achieved without burden to the operator.

We claim:

1. A sheet post-processing apparatus comprising:

discharge means for discharging sheets;

stacking means for stacking the sheets discharged by said discharge means;

input means for inputting information indicative of the presence or absence of fold in the sheets; and control means for controlling said discharge means so as to vary the sheet discharge speed in accordance with the information indicative of the presence or absence of fold in the sheets, which information is entered through said input means, wherein said control means controls said discharge means in such a manner that in case of the absence of fold in the sheet, the sheet is discharged at a first discharge speed, and in case of the presence of fold in the sheet, the sheet is discharged at a second discharge speed faster than the first discharge speed.

2. A sheet post-processing apparatus according to claim 1, wherein said control means controls said discharge means so as to change over the sheet discharge speed to a lower speed in the course of discharge of the sheet at the first or second discharge speeds.

3. A sheet post-processing apparatus according to claim 1, wherein said information indicative of the presence or absence of fold in the sheets is information indicating the presence or absence of a z-fold in the sheets.

4. A sheet post-processing apparatus comprising:

discharge means for discharging sheets;

stacking means for stacking the sheets discharged by said discharge means;

input means for inputting information indicative of a kind of fold in the sheets; and control means for controlling said discharge means so as to vary the sheet discharge speed in accordance with the information indicative of a kind of fold in the sheets, which information is entered through said input means, wherein said control means controls said discharge means in such a manner that in case of the presence of a first kind of fold in the sheet, the sheet is discharged at a first discharge speed, and in case of the presence of a second kind of fold in the sheet, the sheet is discharged at a second discharge speed faster than the first discharge speed.

5. A sheet post-processing apparatus according to claim 4, wherein said control means controls said discharge means so as to change over the sheet discharge speed to a lower speed in the course of discharge of the sheet at the first or second discharge speeds.

6. A sheet post-processing apparatus according to claim 4, wherein said first kind of fold is a half fold, and said second kind of fold is a z-fold.

7. A sheet post-processing apparatus comprising:

discharge means for discharging sheets;

stacking means for stacking the sheets discharged by said discharge means;

input means for inputting information indicative of the presence or absence of fold in the sheets; and control means for controlling said discharge means so as to change over the sheet discharge speed, in the course of discharge of the sheet, from a high speed to a low speed in different timings in accordance with the information indicative of the presence or absence of fold in the sheets, which information is entered through said input means, wherein said control means controls said discharge means in such a manner that in case of the presence of fold in the sheet, the sheet discharge speed is changed over from a high speed to a low speed after a predetermined delay from a predetermined reference timing, and in case of the absence of fold in the sheet, the sheet discharge speed is changed over from a high speed to a low speed before said predetermined delay elapses.

8. A sheet post-processing apparatus according to claim 7, wherein said control means controls said discharge means in such a manner that in case of the presence of fold in the sheet, the sheet is discharged at higher speed compared with that in case of the absence of fold in the sheet.

9. A sheet post-processing apparatus according to claim 7, wherein said information indicative of the presence or absence of fold in the sheets is information indicating the presence or absence of a z-fold in the sheets.

10. A sheet post-processing apparatus comprising:

discharge means for discharging sheets;

stacking means for stacking the sheets discharged by said discharge means;

input means for inputting information indicative of a kind of fold in the sheets; and control means for controlling said discharge means so as to change over the sheet discharge speed, in the course of discharge of the sheet, from a high speed to a low speed in different timings in accordance with the information indicative of a kind of fold in the sheets, which information is entered through said input means, wherein said control means controls said discharge means in such a manner that in case of the presence of a first kind of fold in the sheet, the sheet discharge speed is changed over from a high speed to a low speed after a predetermined delay from a predetermined reference timing, and in case of the presence of a second kind of fold in the sheet, the sheet discharge speed is changed over from a high speed to a low speed before said predetermined delay elapses.

11. A sheet post-processing apparatus according to claim 10, wherein said control means controls said discharge means in such a manner that in case of the presence of the first kind of fold in the sheet, the sheet is discharged at a higher speed compared with that in case of presence of the second kind of fold in the sheet.

12. A sheet post-processing apparatus according to claim 10, wherein said first fold is a z-fold, and said second fold is a half fold.

13. A sheet post-processing apparatus according to claim 11, wherein said first fold is a z-fold, and said second fold is a half fold.

14. A sheet post-processing apparatus comprising:

discharge means for discharging sheets;

stacking means for stacking the sheets discharged by said discharge means;

input means for inputting information indicative of sizes of the sheets; and control means for controlling said discharge means so as to change over the sheet discharge speed, in the course of discharge of the sheet, from a high speed to a low speed in different timings in accordance with the information indicative of sizes of the sheets, which information is entered through said input means wherein said control means controls said discharge means in such a manner that in case of a first size of the sheet, the sheet discharge speed is changed over from a high speed to a low speed after a predetermined delay from a predetermined reference timing, and in case of a second size of the sheet smaller than said first size, the sheet discharge speed is changed over from a high speed to a low speed before said predetermined delay elapses.

* * * * *

UNITED STATES PATENT AND TRADEMARK OFFICE

CERTIFICATE OF CORRECTION

PATENT NO. : 4,938,467

DATED : July 3, 1990

INVENTOR(S) : Takeshi Honjo, et al.

It is certified that error appears in the above-identified patent and that said Letters Patent is hereby corrected as shown below:

IN THE DRAWINGS

Sheet 3, Figure 3, "REGISTRATION CLATCH" should read --REGISTRATION CLUTCH--.

Figure 9:
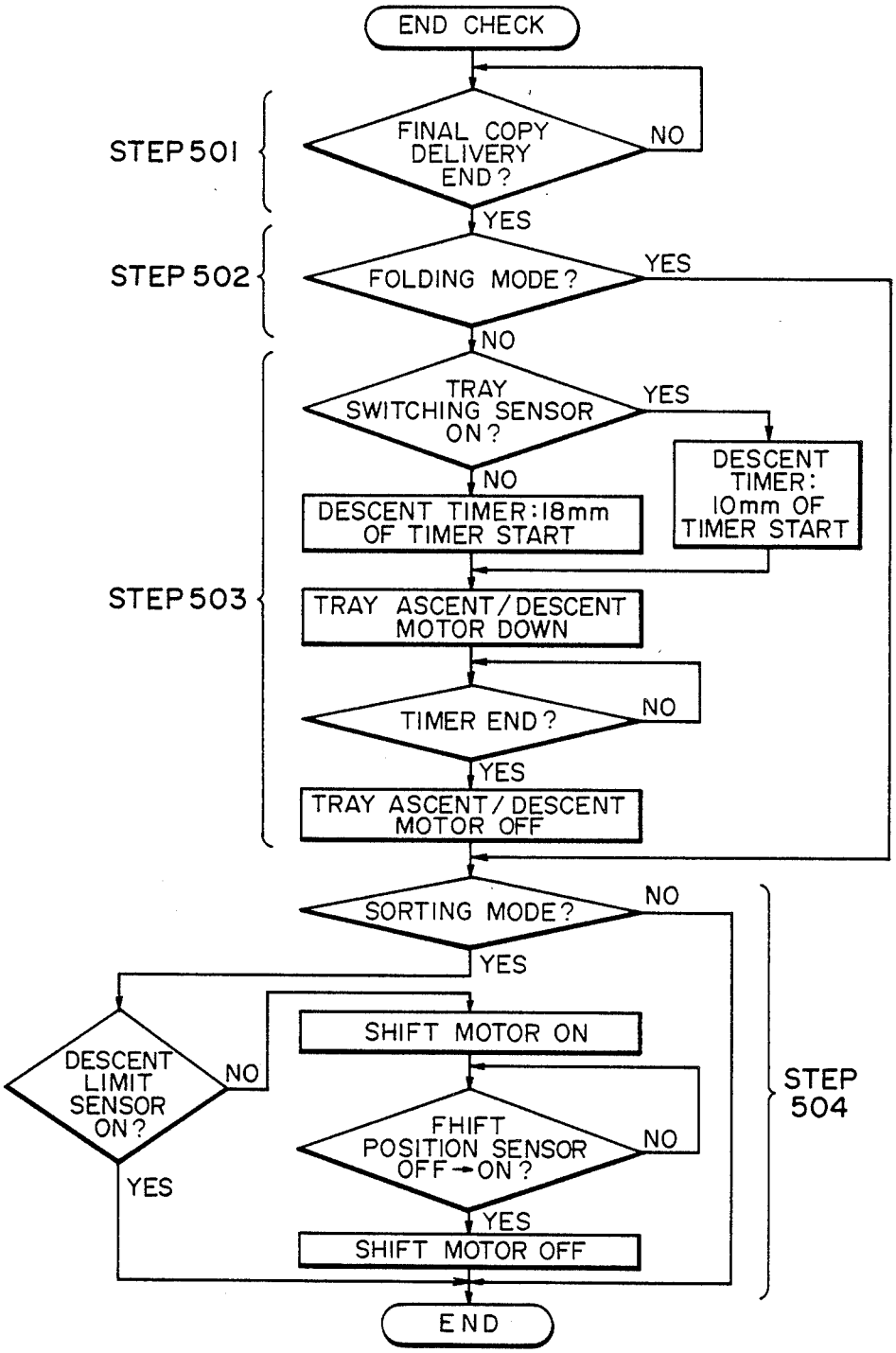

Sheet 16, Figure 9, "FHIFT" should read --SHIFT--.

Column 4, line 41, "sheets Then" should read --sheets. Then--.

Column 8, line 17, "position A" should read --position. A--.
Column 8, line 18, "prevented Also" should read --prevented. Also--.
Column 8, line 32, "according" should read --according to--.

Column 9, line 29, "completely" should read --completely.--.

Signed and Sealed this

Seventeenth Day of November, 1992

*Attest:*

DOUGLAS B. COMER

*Attesting Officer* *Acting Commissioner of Patents and Trademarks*